US010631623B2

(12) United States Patent
Kraemer

(10) Patent No.: US 10,631,623 B2
(45) Date of Patent: Apr. 28, 2020

(54) DEVICE

(71) Applicant: GlaxoSmithKline Consumer Healthcare GmbH & Co KG, München (DE)

(72) Inventor: Hans Kraemer, München (DE)

(73) Assignee: GlaxoSmithKline Consumer Healthcare GmbH and Co. KG, Buehl/Baden (DE)

( * ) Notice: Subject to any disclaimer, the term of this patent is extended or adjusted under 35 U.S.C. 154(b) by 91 days.

(21) Appl. No.: 16/070,794

(22) PCT Filed: Jan. 16, 2017

(86) PCT No.: PCT/EP2017/050745
§ 371 (c)(1),
(2) Date: Jul. 18, 2018

(87) PCT Pub. No.: WO2017/125331
PCT Pub. Date: Jul. 27, 2017

(65) Prior Publication Data

US 2019/0021478 A1 Jan. 24, 2019

(30) Foreign Application Priority Data

Jan. 18, 2016 (GB) ..... 1600846.8

(51) Int. Cl.

| | |
|---|---|
| ***A46B 9/04*** | (2006.01) |
| ***A46B 9/02*** | (2006.01) |
| ***A46B 9/06*** | (2006.01) |
| ***A46D 1/00*** | (2006.01) |

(52) U.S. Cl.
CPC ..... *A46B 9/04* (2013.01); *A46B 9/028* (2013.01); *A46B 9/06* (2013.01); *A46D 1/023* (2013.01);

(Continued)

(58) Field of Classification Search
CPC ... A46B 2200/1066; A46B 9/028; A46B 9/04; A46B 9/06; A46D 1/0207; A46D 1/023; A46D 1/0276
See application file for complete search history.

(56) References Cited

U.S. PATENT DOCUMENTS 6,546,586 B2 * 4/2003 Cho ..... A46B 9/06 15/167.1
7,089,621 B2 * 8/2006 Hohlbein ..... A46B 9/028 15/110

(Continued)

FOREIGN PATENT DOCUMENTS

| | | | |
|---|---|---|---|
| GB | 2325401 | A | 11/1998 |
| WO | WO9924649 | A1 | 5/1999 |
| WO | WO2015085528 | A1 | 6/2015 |

*Primary Examiner* — Marc Carlson
(74) *Attorney, Agent, or Firm* — Roshni A. Sitapara; Joshua C. Sanders

(57) ABSTRACT

A toothbrush head having a bristle surface with tufts of bristles extending therefrom comprising: first tufts of a mixture of co-extruded bristles and unitary bristles located adjacent to the distal end of the bristle surface; second tufts comprising a mixture of co-extruded bristles and unitary bristles located adjacent to the proximal end of the bristle surface; third tufts comprising tapered bristles located adjacent to the widthways opposite sides of the bristle surface; and fourth tufts comprising a mixture of co-extruded bristles and tapered bristles longer than the co-extruded bristles located as a cluster of fourth tufts widthways between the third tufts and longitudinally between the first and second tufts.

22 Claims, 3 Drawing Sheets

(52) U.S. Cl.
CPC ..... *A46D 1/0207* (2013.01); *A46D 1/0276* (2013.01); *A46B 2200/1066* (2013.01)

(56) References Cited

U.S. PATENT DOCUMENTS

D623,415 S * 9/2010 Geiberger ..... D4/104
7,954,191 B2 * 6/2011 Hohlbein ..... A46B 9/04 15/110
10,004,322 B2 * 6/2018 Jungnickel ..... A46B 9/025
2005/0102775 A1 * 5/2005 Kressner ..... A46B 9/04 15/22.1
2009/0013489 A1 * 1/2009 Binet ..... A46B 9/028 15/167.1
2009/0094770 A1 * 4/2009 Zoschke ..... A46D 1/00 15/207.2
2010/0223745 A1 * 9/2010 Kraemer ..... A46B 9/02 15/167.1
2014/0359956 A1 * 12/2014 Jungnickel ..... A46B 9/025 15/167.1
2015/0150367 A1 * 6/2015 Moskovich ..... A46B 9/04 15/167.1
2015/0282910 A1 * 10/2015 Furdui-Carr ..... A61C 17/228 15/22.2
2015/0289638 A1 * 10/2015 Jungnickel ..... A46B 9/04 15/167.1
2015/0327666 A1 * 11/2015 Hohlbein ..... A46B 3/06 300/21
2017/0020275 A1 * 1/2017 Xi ..... A46B 11/0068
2017/0127818 A1 * 5/2017 Wagstaff ..... A46D 1/0276

* cited by examiner

DEVICE

This application is a 371 of International Application No. PCT/EP2017/050745, filed Jan. 16, 2017, which claims priority to GB 1600846.8 filed Jan. 18, 2016.

FIELD OF THE INVENTION

This invention relates to toothbrushes, in particular to the bristle configuration of toothbrush heads. Especially this invention relates to improved toothbrush bristle configurations comprising combinations of different types of bristle filaments.

BACKGROUND TO THE INVENTION

Toothbrushes are well known articles generally comprising a head for insertion in the user's mouth and a grip handle to be held by the user during use. Toothbrushes may be manual toothbrushes in which the head is moved within the user's mouth in contact with the user's teeth by hand action applied to the handle, or power toothbrushes in which the handle incorporates a motor by means of which the head is moved. The toothbrush head normally has a surface, termed herein the "bristle surface" from which plural tufts of bristles extend in a bristle direction.

Toothbrush bristles are well known to consist of fine filaments comprised of one or more polymer material. A variety of types of toothbrush bristles are known.

The most common type of bristle is a unitary filament i.e. made of a single polymer material, typically polyamide (e.g. nylon such as Nylon 6.12) such as the bristle material Tynex™, polybutylene terephthalate (PBT) or polyethylene terephthalate (PET), of generally uniform circular cross-section and normally being end-rounded, i.e. having its end remote from the bristle surface rounded to prevent damage to the soft mouth tissues such as the gums.

Another type is a so-called tapered bristle comprising a filament, usually a unitary filament, which tapers toward its end remote from the bristle surface in a conical sloping profile over a substantial part of its length remote from the bristle face, e.g. 10-50% of its length remote from the bristle surface to a sharp point. The term "tapered bristles" is a term of the toothbrush bristle art, a synonym being "pointed bristles" as for example used in US-A-2006/0096053, or "needle shaped bristles" as for example used in EP-A-1 425 989. For example such tapered bristles are disclosed in EP-A-1 234 525, EP-A-1 415 572, U.S. Pat. No. 6,546,586, WO-A-97/42853, WO-A-97/42854, WO-A-01/32053, WO-A-82741, EP-A-0 596 633 among others. Tapered bristles, being thinner at their upper pointed end, have different bending and flexibility characteristics to non-tapered filaments. Tapered bristles are generally more flexible than non-tapered bristles of the same cylindrical diameter. In particular tapered bristles are known for efficacy in reaching into the spaces between the teeth, the so called "interproximal" spaces. Typically, tapered bristles may be made of polyamide (nylon such as Nylon 6.12), or polyester such as polybutylene terephthalate (PBT) or polyethylene terephthalate (PET). Two types of such tapered bristles are used, one type being mechanically tapered in which the ends of the filaments are mechanically ground to a point, and another type being chemically tapered in which the ends of the filaments are chemically eroded to a point. As disclosed for example in U.S. Pat. No. 6,090,488 PBT and PET bristles are preferably eroded chemically to a tapered end. Chemically tapered bristles normally taper to a finer point than mechanically tapered bristles.

It is known to combine tapering and non-tapering bristles on a toothbrush head. For example U.S. Pat. No. 6,546,586, US-A-2006/0096053, U.S. Pat. No. 3,103,679, US-A-2008/0271276, WO-A-96/16571 and DE-A-35 28 596 among others disclose toothbrush heads in which each tuft comprises plural bristle filaments in the form of shorter filaments of uniform cross section and longer filaments which taper toward their upper end.

Another type of bristle is a so-called co-extruded bristle comprising a filament made of two different polymer materials. These different polymer materials may be arranged as a core and outer, e.g. concentric, sheath formed respectively of these different materials. Examples of such co-extruded bristles are disclosed in WO-A-97/14830 and WO-A-98/26117. A particular type of such co-extruded bristles disclosed in WO-A-99/24649 (Pedex) has a core of one material such as a polyolefin, particularly a thermoplastic elastomer (TPE), and a sheath made of PBT or polyamide. Typical such materials are a core of Hytrel 8238 thermoplastic elastomer and an outer sheath of Ultradur B4500 PBT. In one commercially available (e.g. from Pedex GmbH) form of such coextruded bristles the core extends to the outer surface of the sheath at one or more place around the perimeter of the bristle, and in one such form the polyolefin core is cross-shaped, with segments of the sheath material between the arms of the cross, and the ends of the arms of the cross being exposed at the outer surface of the filaments.

Typically toothbrush bristle filaments are circular in cross section with a diameter ranging between about 0.18 mm for soft bristles, through about 0.3 mm for medium bristles, to ca. 0.36 mm for hard bristles. Typically toothbrush bristles are arranged on a toothbrush head in tufts of a generally circular cross section, typically ca. 1.0-1.5 mm diameter.

It is an object of this invention to provide an improved toothbrush head incorporating combinations of different types of bristles, particularly end-rounded, tapered and co-extruded bristles, for example providing improved tooth cleaning, particularly in the interproximal spaces, at the gingival margin and in subgingival areas. Other objects and advantages of the invention will be apparent from the following description.

SUMMARY OF THE INVENTION

According to a first aspect of this invention there is provided a toothbrush head connected or connectable to a toothbrush grip handle to define a head-handle longitudinal direction and a widthways direction perpendicular to the longitudinal direction, the head having a bristle surface with a distal end further from the handle and a proximal end closer to the handle, and having widthways opposite sides, tufts of bristles extending from the bristle surface in a bristle direction transverse to the longitudinal direction and to the width direction, characterised in that the tufts of bristles comprise:

first tufts each comprising a mixture of co-extruded bristles and unitary bristles, and located as a cluster of first tufts adjacent to the distal end of the bristle surface;

second tufts each comprising a mixture of co-extruded bristles and unitary bristles, and located as a cluster of second tufts adjacent to the proximal end of the bristle surface;

third tufts each comprising tapered bristles located adjacent to the widthways opposite sides of the bristle surface;

fourth tufts each comprising a mixture of co-extruded bristles and tapered bristles longer than the co-extruded bristles and located as a cluster of fourth tufts widthways between the third tufts and longitudinally between the first and second tufts.

First, second and fourth bristle tufts of the toothbrush head of this invention may be advantageous for use in toothbrushes independent of the other tufts with which they are combined as described above.

Therefore another aspect of this invention is a toothbrush head provided with one or more tuft comprising a mixture of co-extruded bristles and unitary bristles.

Therefore another aspect of this invention is a toothbrush head provided with one or more tuft comprising a mixture of co-extruded bristles and tapered bristles longer than the co-extruded bristles.

DETAILED DESCRIPTION OF THE INVENTION

Figure 1:
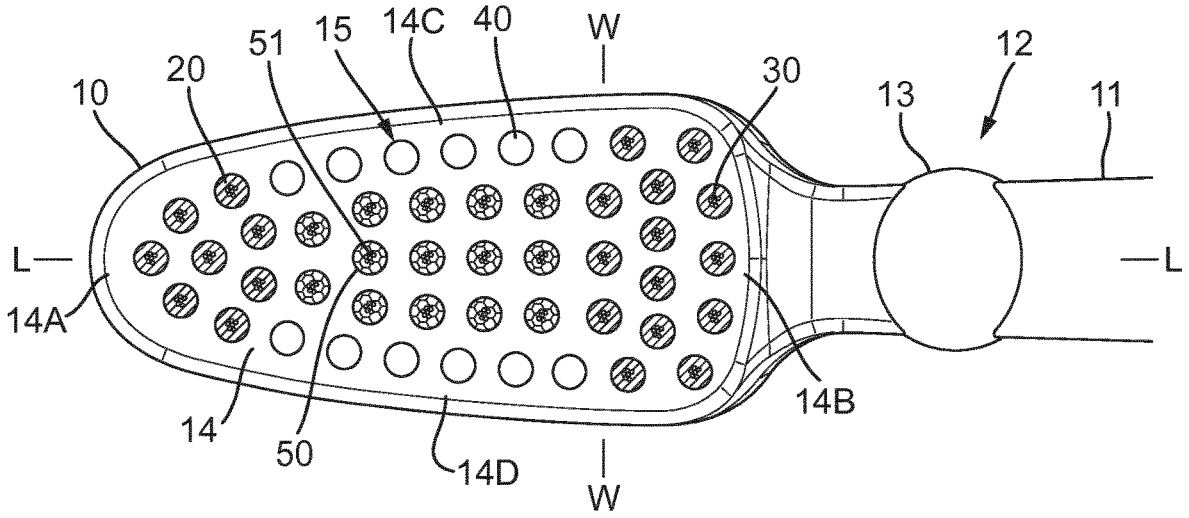
FIG. 1 shows a plan view of a toothbrush head of this invention.

The bristle direction may be at a non-perpendicular angle to the longitudinal and/or width directions. For example one or more of the first, second, third or fourth tufts may lean in the longitudinal direction such that the end of the tuft remote from the bristle surface is either longitudinally nearer to the distal end, or alternatively further from the distal end, than the end of the tuft fixed into the bristle surface. Preferably the bristle direction for at least some of the tufts is perpendicular to the longitudinal and width directions. Preferably the bristle direction of all the first, second, third and fourth tufts is perpendicular to the longitudinal and width directions. Preferably the bristle surface is planar and the first, second, third and fourth tufts all extend perpendicular to this planar bristle surface.

Typically there may be 5-10 first tufts, e.g. 8. Typically there may be 5-16 second tufts, e.g. 8-14.

The co-extruded bristles in the first and second tufts are preferably of the above-mentioned type having a core of a first material such as a polyolefin, such as a thermoplastic elastomer (TPE) material, which extends to the outer surface of the sheath, which may be made of a polyester material such as PBT or polyamide, at one or more place around the perimeter, so that for example in cross section the core may be cross-shaped, with segments of the sheath material between the arms of the cross. The unitary bristles may be polyamide (nylon e.g. Nylon 6.12), PBT or PET filaments, polyamide bristles being preferred.

In the first and second tufts the co-extruded and unitary bristles preferably extend to the same length from the bristle surface. The first tufts may extend to the same length from the bristle surface as the second tufts, but preferably the first tufts extend further than the second tufts. Typically the first tufts may extend 10.5-11.5 mm, and if the second tufts extend less far than the first tufts they may extend 1-2 mm less e.g. 1.5 mm less. For example first tufts may extend ca. 11 mm and second tufts may extend ca. 9.5 mm from the bristle surface.

The coextruded and unitary bristles may be disposed randomly within the first and/or second tufts, or either the coextruded or unitary bristles may be located about the centre of the tuft, surrounded respectively by the unitary or coextruded bristles.

Typically the third tufts may be positioned in one or more, preferably one, longitudinal line about the longitudinal midpoint of the widthways opposite edges, for example to occupy ca. 30-60%, e.g. 40-50% of the length of each widthways opposite side, and being the most widthways positioned tufts over this length. For example there may be 5-8, e.g. 6 or 7, third tufts along each widthways opposite side of the bristle surface.

The third tufts located adjacent to the widthways opposite sides of the bristle surface may for example comprise tapered PBT or polyamide (nylon) bristles, tapered PBT bristles being preferred. The bristles of the third tufts may be mechanically or chemically tapered, chemically tapered PBT bristles being preferred. The third tufts may consist entirely of tapered bristles. The third tufts may be composed entirely of tapered bristles.

The longest of the tapered bristles in the third tufts preferably extend further from the bristle surface than the first tufts. Typically the third tufts may extend 11-13 mm from the bristle surface, e.g. ca. 12 mm. The third tufts may comprise tapered bristles all of the same length, or of differing lengths giving these third tufts a ragged ended appearance. Alternatively the ends of the bristles in the third tufts may be profiled so that the ends of the third tufts have an overall regular e.g. conical shape.

The fourth tufts are located as a cluster of tufts widthways between the third tufts and longitudinally between the first and second tufts, i.e. in a generally central position of the bristle surface. There may for example be 12-20 fourth tufts, typically 14-18. The fourth tufts may be arranged in generally longitudinally sequential lines along and/or generally widthways rows across the bristle surface.

The fourth tufts may for example comprise a mixture of co-extruded bristles of the above-mentioned type having a core of one polymer material such as a polyolefin, and a sheath of another polymer material such as polyester e.g. PBT or PET, or polyamide, and the core extends to the outer surface of the filament at points around the perimeter, so that for example in cross section the polyolefin core is cross-shaped, with segments of the sheath material between the arms of the cross, and tapered bristles made of polyamide (nylon e.g. Nylon 6.12), PBT or PET and which are mechanically or chemically tapered. Polyamide tapered bristles are preferred in these fourth tufts.

In the fourth tufts the co-extruded bristles may extend from the bristle surface to the same length as the bristles of the second tufts. In the fourth tufts the tapered bristles may extend further from the bristle surface than the first bristles, for example 12-14 mm, typically ca. 13.5 mm, i.e. making these tapered bristles of the fourth tufts the longest bristles on the bristle surface.

The coextruded and unitary bristles may be disposed randomly within the fourth tufts, or either the coextruded or unitary bristles may be located about the centre of the fourth tufts, surrounded respectively by the unitary or coextruded bristles.

A preferred embodiment of the toothbrush head of this invention comprises, in longitudinal sequence from the distal end of the head:

a cluster of first tufts being the most distal tufts on the bristle surface and in which the bristles extend a first bristle distance from the bristle surface;

a cluster of second tufts being the most proximal tufts on the bristle surface including bristles extending a second bristle distance from the bristle surface;

a cluster of fourth tufts each fourth tuft comprising co-extruded bristles extending from the bristle surface a fourth co-extruded bristle distance less than the first bristle distance and tapered bristles extending from the bristle surface a fourth tapered bristle distance further than the first bristle distance;

the cluster of fourth tufts being flanked on each of its widthways opposite sides by a single longitudinally extending line of third tufts in which at least some of the bristles extend a third bristle distance longer than the first bristle distance and less than the fourth tapered bristle distance.

Preferably in this preferred embodiment the bristle surface is planar and the bristle direction of all the bristles is perpendicular to the bristle surface.

The toothbrush head and its grip handle may be made of the conventional plastics materials of which toothbrushes are made, such as polypropylene, or of a combination of parts made of respectively such plastics materials and thermoplastic elastomeric (TPE). Known injection moulding processes e.g. as disclosed in U.S. Pat. Nos. 5,761,759 and 5,946,759 may be used to make such heads and handles.

The bristles of the first, second, third and fourth tufts may be fixed into the head by conventional processes. For example in one such well-known process the head may be made using injection moulding with holes in the bristle surface. The ends of tufts of bristles may be bound in small metal anchors and these anchors may be located in these holes and held in place by the resilience of the adjacent plastics material. For example in another well-known process the ends of the tufts may be supported extending into the mould cavity in which the head is to be made by injection moulding and the plastics material injected in a fluid state around these ends so that the ends are firmly embedded in the head when the injected plastics material hardens.

Bristle filaments, including tapered bristle filaments are often provided in lengths corresponding to double the length to which the bristle is intended to extend from the bristle surface, in the case of tapered bristles consequently having two opposite tapered ends, which are folded into a "U" shape and the fold of the "U" is fixed into the head. PBT tapered bristles, i.e. the bristles of the third tufts are commonly provided in such a form. Alternatively tapered bristles may be provided as filaments with a single tapered end and an opposite end which is fixed into the toothbrush head.

The handle may incorporate features which modify the flexibility of the handle, for example the folded region disclosed in EP-A-0336641.

The toothbrush head of the invention may be a head of a manual toothbrush, i.e. to be moved in contact with the user's teeth solely by hand action, or the head of a power toothbrush in which the head is moved by an electric, e.g. battery powered, motor located in the handle. In the case of a power toothbrush the toothbrush head of the invention may be permanently connected or replaceably connectable to the toothbrush handle containing the drive motor by means well known in the toothbrush art, e.g. adapted to move the toothbrush head in a Bass-type motion under the action of the drive motor.

The invention will now be described by way of example only with reference to the accompanying figures.

EXAMPLES

Figure 2:
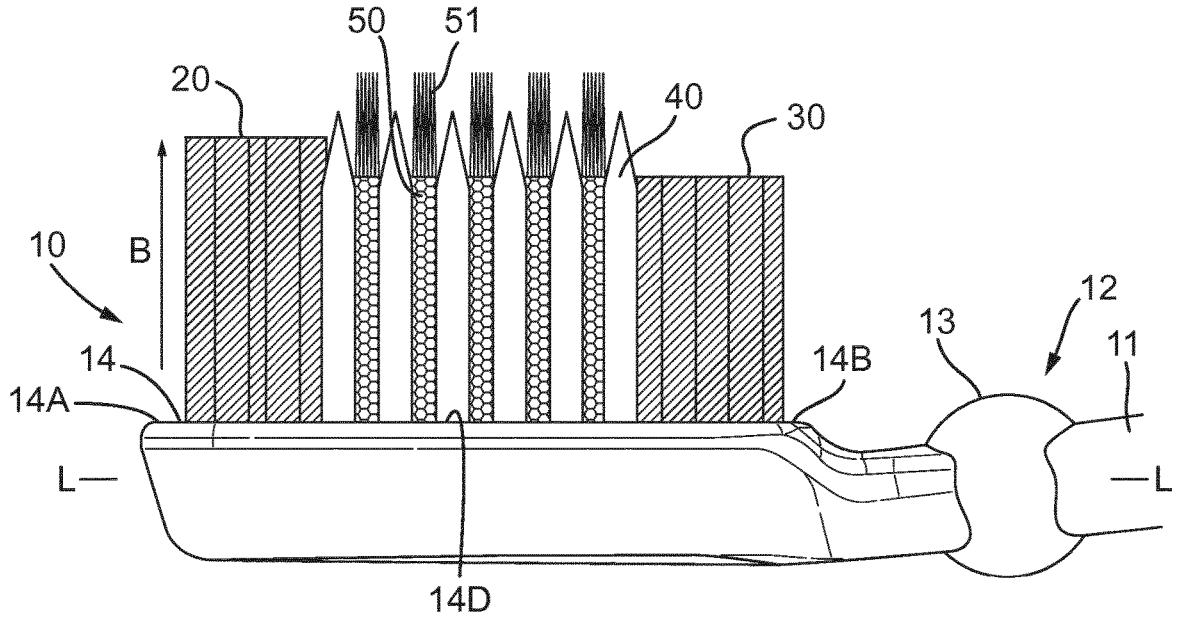
FIG. 2 shows a side elevation view of the toothbrush head of FIG. 1.
Figure 3:
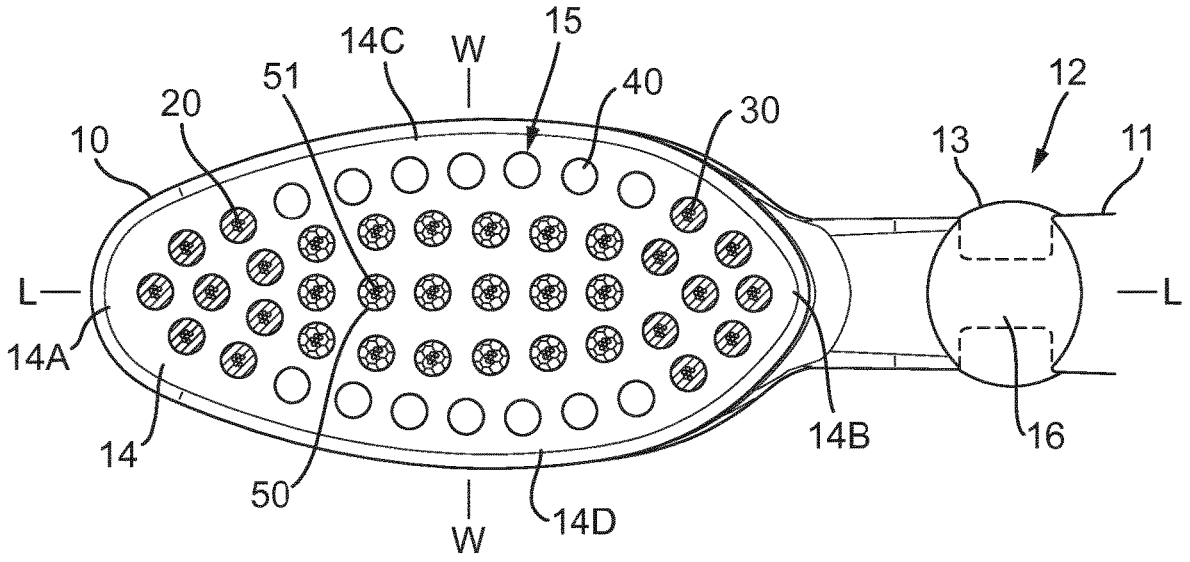
FIG. 3 shows a plan view of another toothbrush head of this invention.

Referring to FIGS. 1, 2 and 3 a toothbrush head 10 overall is shown integrally made of plastics material such as polypropylene with a toothbrush grip handle 11 thereby defining a head-handle longitudinal direction L-L and a widthways direction W-W perpendicular to the longitudinal direction L-L. Only that part of the handle 11 closest to the head 10 is shown as the handle 11 may be entirely conventional. FIGS. 1 and 3 respectively show a toothbrush head that tapers toward its distal end, of a generally oval shape in plan.

A flexible link 12 is provided in the handle 11 close to the head 10 to make the handle 11 more flexible to thereby relieve application of excessive brushing pressures on the user's teeth. The flexible link 12 is of a known type comprising an integral thin, flexible link (not shown in FIG. 1) of the plastics material of the handle 11 enclosed in a generally spherical mass of a soft thermoplastic elastomer material 13. Such a flexible link is for example disclosed in WO-A-97/24979 and WO-A-98/37788.

The head 10 has a planar bristle surface 14 with a distal end 14A further from the handle 11 and a proximal end 14B closer to the handle 11, and having widthways opposite sides 14C and 14D.

Tufts of bristles 20, 30, 40, 50 extend from the bristle surface 14 in a bristle direction B which is perpendicular to both the longitudinal direction L-L and to the width direction W-W. The tufts 20, 30, 40, 50 comprise tufts positioned and constituted as described below, and each tuft 20, 30, 40, 50 is fixed using a conventional metal anchor (not shown) in a conventional hole 15 in the bristle surface 14. The holes 15 are circular in cross section with a diameter ca. 1.3 mm.

Figure 4:
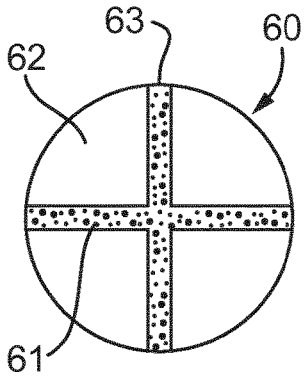
FIG. 4 shows a cross section through a coextruded bristle.

Adjacent to the distal end 14A of the bristle surface 14 is a cluster of first tufts 20, there being eight first tufts 20 in the heads of FIGS. 1 and 3. These first tufts 20 each comprise a mixture of co-extruded bristles as shown 60 in FIG. 4 and polyamide (Nylon 6.12) unitary bristles as shown 70 in FIG. 5. As shown in FIG. 4 the co-extruded bristles 60 in the first tufts 20 have a cross section comprising a core 61 of a thermoplastic elastomer (TPE) material (e.g. Hytrel 8238 thermoplastic elastomer) which extends to the outer surface of the bristle 60, and a sheath 62 made of PBT (e.g. Ultradur B4500), so that for example in cross section the polyolefin core 61 is cross-shaped, with segments of the PBT material of the sheath 61 between the arms of the cross and the TPE material of the core 61 being exposed at areas 63 of the bristles 60.

Figure 5:
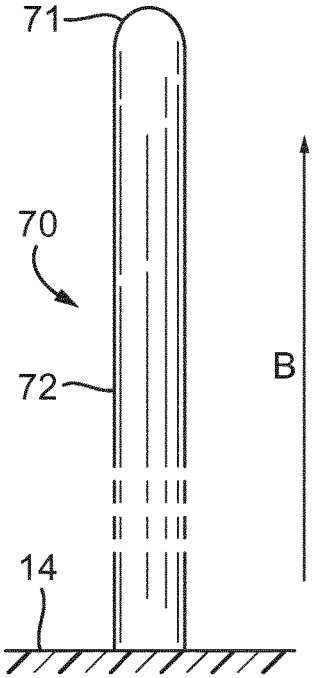
FIG. 5 shows the shape of the end of an end-rounded unitary bristle.

FIG. 5 shows the end region 71 of the unitary bristles 70 in the first tufts 20, showing the generally hemispherical or hemi-oval end shape of the end region 71 of these end rounded bristles at the upper end of a cylindrical region 72, which are made of polyamide (e.g. nylon 6.12). The co-extruded 60 and unitary bristles 70 in the first tufts 20 of the heads of both FIGS. 1 and 3 extend perpendicularly to the same length of 11 mm from the bristle surface 14.

Adjacent to the proximal end 14B of the bristle surface 14 is a cluster of second tufts 30, there being fourteen in the head of FIG. 1 and eight in the head of FIG. 3. These second tufts 30 each comprise a mixture of co-extruded bristles and polyamide (Nylon 6.12) unitary bristles having the same construction as in the first tufts 20. In the second tufts 30 of the heads of both FIGS. 1 and 3 the co-extruded 60 and unitary bristles 70 extend perpendicularly to the same length of ca. 9.5 mm from the bristle surface 14.

Figure 6:
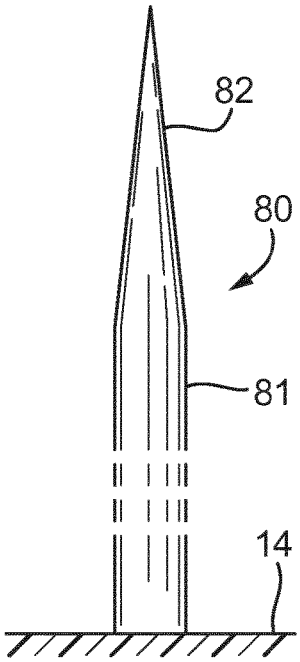
FIG. 6 shows the shape of the end of a tapered bristle.
Figure 7:
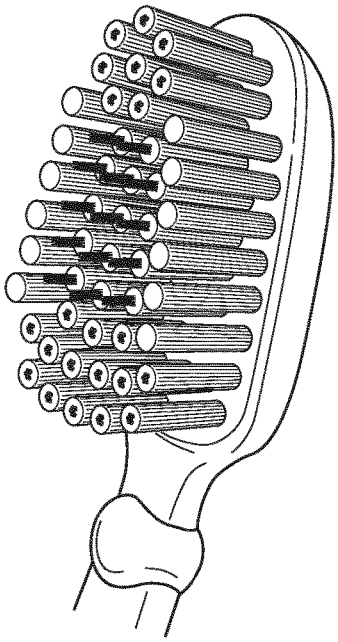
FIG. 7 shows a three dimensional view of a toothbrush head of this invention.

Adjacent to each of the widthways opposite sides 14C, 14D of the bristle surface 14 are third tufts 40 extending along these sides 14C, 14D in a longitudinal line occupying ca. 40-50% of the longitudinal middle portion of the length of each widthways opposite side 14C, 14D and being the most widthways positioned tufts over this length. In the heads of FIGS. 1 and 3 there are respectively six and seven third tufts 40 along each widthways opposite side. The third tufts 40 are composed entirely of tapered PBT bristles as shown as 80 in FIG. 6 having a profile comprising a substantially uniform cylindrical cross section over their lower region 81 closest to bristle surface 14, with an upper part 82 tapering in a sharply pointed conical shape. The tapered bristles in the third tufts 40 are filaments having both ends tapered and which are folded over and the fold fixed into the surface 14 in a known manner. In FIGS. 2 and 3 the ends of the third tufts 40 are shown as being in a conical profile (in addition to comprising tapered bristles 80). Consequently the ends of the individual bristles in the third tufts 40 are at different lengths from the surface 14. The longest tapered bristles 80 in the third tufts 40 of the heads of both FIGS. 1 and 3 extend further from the bristle surface 14 than the first tufts 20, to a maximum distance of 12 mm from the bristle surface 14. However the ends of the third tufts 40 may have other profiles e.g. they may be cut flat perpendicular to the length direction of the tufts 40, or the ends of the individual bristles may vary in their length from the surface so that the ends of the tufts 40 have an uneven ragged profile.

Located widthways between the third tufts 40 and longitudinally between the first 20 and second tufts 30 is a cluster of fourth tufts 50, fourteen in FIG. 1 and eighteen in FIG. 3, which are flanked on each of their widthways opposite sides by the third tufts 40. The fourth tufts 50 comprise a mixture of co-extruded bristles as shown 60 in FIG. 4 which in the heads of both FIGS. 1 and 3 extend from the bristle surface 14 to the same length ca. 9.5 mm as the second tufts 30, and longer polyamide (nylon 6.12) tapered bristles 51 as shown 80 in FIG. 6 which in the heads of both FIGS. 1 and 3 extend further from the bristle surface than the first bristles 20 i.e. to ca. 13.5 mm making these longer tapered bristles 51 of the fourth tufts 50 the longest bristles extending from the bristle surface 14.

Although in FIGS. 1 and 3 the unitary bristles in first and second tufts 20 and 30, and the longer tapered bristles 51 in fourth tufts 50 are shown as disposed about the central longitudinal axis of the tuft 20, 30, 50, the respective unitary and tapered bristles 51 may be disposed in other ways e.g. randomly in the tufts.

FIG. 3 also shows the internal construction of the flexible link 12. Within the generally spherical mass of elastomer material 13 is a link 16 of plastics material integrally formed with the plastics material of longitudinally adjacent parts of the handle 11.

The toothbrush head 10 of this invention may be used for tooth brushing in a conventional manner. For example when the toothbrush is a manual toothbrush the known Bass brushing technique may be used. It is found that the coextruded bristles 60 of the first 20 and second 30 tufts are effective at removing plaque from the teeth. The tapered bristles 80 of the fourth tufts 50 are found to be effective at penetrating and cleaning the interdental spaces between the teeth, and the polyamide third tufts 40 are found to be effective at cleaning the gum line.

The invention claimed is:

1. A toothbrush head connected or connectable to a toothbrush grip handle to define a head-handle longitudinal direction and a widthways direction perpendicular to the longitudinal direction, the head having a bristle surface with a distal end further from the handle and a proximal end closer to the handle, and having widthways opposite sides, tufts of bristles extending from the bristle surface in a bristle direction transverse to the longitudinal direction and to the width direction, characterised in that the tufts of bristles comprise:

first tufts each comprising a mixture of co-extruded bristles and unitary bristles, and located as a cluster of first tufts adjacent to the distal end of the bristle surface;

second tufts each comprising a mixture of co-extruded bristles and unitary bristles, and located as a cluster of second tufts adjacent to the proximal end of the bristle surface;

third tufts each comprising tapered bristles located adjacent to the widthways opposite sides of the bristle surface;

fourth tufts each comprising a mixture of co-extruded bristles and tapered bristles longer than the co-extruded bristles and located as a cluster of fourth tufts widthways between the third tufts and longitudinally between the first and second tufts.

2. A toothbrush head according to claim 1 characterised in that the bristle direction of all the first, second, third and fourth tufts is perpendicular to the longitudinal and width directions.

3. A toothbrush head according to claim 2 characterised in that the bristle surface is planar and the first, second, third and fourth tufts all extend perpendicular to this planar bristle surface.

4. A toothbrush head according to claim 1 characterised in that there are 5-10 first tufts.

5. A toothbrush head according to claim 1 characterised in that there are 5-16 second tufts.

6. A toothbrush head according to claim 1 characterised in that the unitary bristles in the first and second tufts are polyamide bristles.

7. A toothbrush head according to claim 1 characterised in that in the first and second tufts the co-extruded and unitary bristles extend to the same length from the bristle surface.

8. A toothbrush head according to claim 1 characterised in that the first tufts extend further from the bristle surface than the second tufts.

9. A toothbrush head according to claim 1 characterised in that the third tufts are positioned in one longitudinal line about the longitudinal midpoint of the widthways opposite edges of the bristle surface and are the most widthways positioned tufts over this length.

10. A toothbrush head according to claim 9 characterised in that there are 5-8, third tufts along each widthways opposite side of the bristle surface.

11. A toothbrush head according to claim 1 characterised in that the third tufts comprise tapered PBT bristles.

12. A toothbrush head according to claim 1 characterised in that the longest of the tapered bristles in the third tufts extend further from the bristle surface than the first tufts.

13. A toothbrush head according to claim 1 characterised in that the fourth tufts are located as a cluster of tufts widthways between the third tufts and longitudinally between the first and second tufts.

14. A toothbrush head according to claim 13 characterised in that there are 12-20 fourth tufts.

15. A toothbrush head according to claim 1 characterised in that the tapered bristles of the fourth tufts comprise polyamide tapered bristles.

16. A toothbrush head according to claim 1 characterised in that in the fourth tufts the co-extruded bristles extend from the bristle surface to the same length as the second bristles.

17. A toothbrush head according to claim 16 characterised in that in the fourth tufts the tapered bristles extend further from the bristle surface than the first bristles.

18. A toothbrush head according to claim 1 characterised in that the co-extruded bristles in the first, second and fourth tufts have a core of a polyolefin material which extends to the outer surface of a sheath made of polyamide at points around the perimeter.

19. A toothbrush head according to claim 18 characterised in that in cross section the polyolefin core is cross-shaped with segments of the sheath material between the arms of the cross.

20. A toothbrush head according to claim 1 characterised in that the toothbrush head comprises, in longitudinal sequence from the distal end of the head:

a cluster of first tufts being the most distal tufts on the bristle surface and in which the bristles extend a first bristle distance from the bristle surface;

a cluster of second tufts being the most proximal tufts on the bristle surface including bristles extending a second bristle distance from the bristle surface;

a cluster of fourth tufts each fourth tuft comprising co-extruded bristles extending from the bristle surface a fourth co-extruded bristle distance less than the first bristle distance and tapered bristles extending from the bristle surface a fourth tapered bristle distance further than the first bristle distance;

the cluster of fourth tufts being flanked on each of its widthways opposite sides by a single longitudinally extending line of third tufts in which at least some of the bristles extend a third bristle distance longer than the first bristle distance and less than the fourth tapered bristle distance.

21. A toothbrush head according to claim 1 being the head of a manual toothbrush to be moved in contact with the user's teeth solely by hand action.

22. A toothbrush head according to claim 1 being the head of a power toothbrush in which the head is moved by an electric motor located in the handle.

* * * * *